United States Patent [19]

Fairchild

[11] 4,434,069

[45] Feb. 28, 1984

[54] PLASTIC BOTTLE CLEANER

[75] Inventor: Meredith H. Fairchild, Whittier, Calif.

[73] Assignee: Purex Corporation, Lakewood, Calif.

[21] Appl. No.: 402,778

[22] Filed: Jul. 28, 1982

[51] Int. Cl.[3] ..... C11D 7/12; C11D 1/66; C11D 3/10

[52] U.S. Cl. ..... 252/174.14; 252/156; 252/157; 252/DIG. 10; 252/DIG. 1; 252/DIG. 14; 252/174.21; 134/29; 134/30; 134/22.17; 134/25.1; 134/25.4

[58] Field of Search ..... 252/156, 157, DIG. 10, 252/DIG. 1, DIG. 14, 174.14, 174.21, 174.22; 134/29, 30, 22.17, 25.1, 25.4

[56] References Cited

U.S. PATENT DOCUMENTS

| | | | |
|---|---|---|---|
| 2,976,248 | 3/1961 | Otrhalek | 252/156 |
| 3,463,737 | 8/1969 | Kasperl et al. | 252/153 |
| 3,491,029 | 1/1970 | Kasperl et al. | 134/29 |
| 3,672,993 | 6/1972 | Mitchell et al. | 134/3 |
| 3,944,500 | 3/1976 | Gancy et al. | 252/182 |
| 3,971,726 | 7/1976 | Smith et al. | 252/132 |
| 3,996,149 | 12/1976 | Burke, Jr. | 252/160 |
| 4,049,586 | 9/1977 | Collier | 252/532 |
| 4,081,395 | 3/1978 | Talley | 252/156 |
| 4,196,093 | 4/1980 | Clarke et al. | 252/99 |
| 4,210,550 | 7/1980 | Cornelissens | 252/90 |
| 4,212,761 | 7/1980 | Ciaccio | 252/156 |
| 4,294,718 | 10/1981 | Kaeser | 252/135 |
| 4,298,493 | 11/1981 | Schreiber | 252/135 |
| 4,299,716 | 11/1981 | Cottrell et al. | 252/99 |

FOREIGN PATENT DOCUMENTS

| | | |
|---|---|---|
| 1806733 | 5/1970 | Fed. Rep. of Germany . |
| 1532533 | 4/1979 | Fed. Rep. of Germany . |
| 709475 | 5/1954 | United Kingdom . |

*Primary Examiner*—John E. Kittle
*Assistant Examiner*—Hoa Van Le
*Attorney, Agent, or Firm*—William W. Haefliger

[57] ABSTRACT

A process of cleaning a polycarbonate bottle includes (a) washing the bottle with a composition consisting essentially of an aqueous basic solution containing the members: alkali metal carbonate, alkali metal bi-carbonate and a low foaming detergent, and (b) then rinsing the bottle with water.

18 Claims, 1 Drawing Figure ml/s 0.1 NORMAL ACID

A - 50 ml OF 0.35% SODIUM HYDROXIDE

B - 50 ml OF 1.25% NOVEL CLEANER OF PRESENT INVENTION

A - 50 ml OF 0.35% SODIUM HYDROXIDE

B - 50 ml OF 1.25% NOVEL CLEANER OF PRESENT INVENTION

PLASTIC BOTTLE CLEANER

BACKGROUND OF THE INVENTION

This invention relates generally to cleaning of poly carbonate drinking water bottles, and more particularly concerns cleaning compositions of this type that are free of chlorine and will not cause stress cracking or crazing of such containers.

The problems of chlorine fume production, and stress cracking and crazing of polycarbonate containers arise during washing or cleaning of same, using conventional cleaning compositions. Such containers are commonly used for drinking water, they are considered re-usable, and therefore must be washed or cleaned. Public health regulations require an alkalinity titration equivalent to 0.35% as sodium hydroxide; however, a pH higher than 11.0 can be detrimental and cause the described crazing and stress cracking. Also, since the bottles are used for drinking water, the cleaning compositions must be non-toxic and leave no objectionable odor or taste. No way was known to avoid such problems, using conventional cleaning compositions.

SUMMARY OF THE INVENTION

It is a major object of the invention to provide a cleaning composition, and process, that avoids the above problems.

In its composition aspects, the invention concerns the provision of alkali metal salts so combined that they have, at use concentrations, a pH of 11.0 or less and an adequate reserve of titratable alkalinity, at least equivalent to 0.35 percent caustic soda (sodium hydroxide), when titrated to the colorless phenolphthalein end point, which is about pH 8.0.

In its process aspects, the invention involves the steps:

(a) washing the poly carbonate bottle with a composition consisting of a basic solution containing an alkali metal carbonate, an alkali metal bi-carbonate and low-foaming surfactant, and (b) rinsing the bottle with water.

As will appear, the solution pH is adjusted below 11.0 by adjustment of ingredient weight percentages.

DETAILED DESCRIPTION

Figure 1:
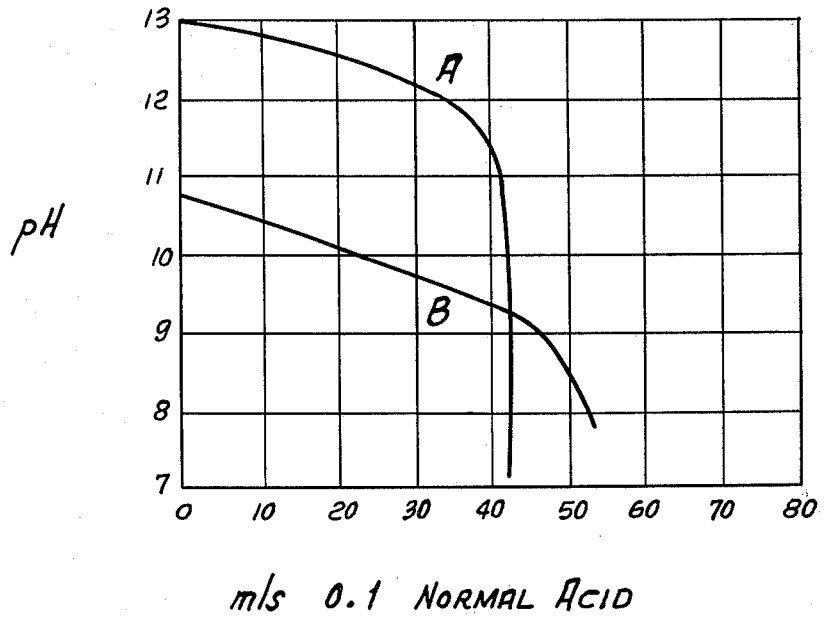

The aqueous washes or solutions of the present invention are based on use of mixtures of sodium carbonate, sodium bi-carbonate and a small percentage of low foaming surfactant. As will appear, a cleaning composition or concentrate is prepared or supplied, for example, and added to or combined with a much larger (relative) volume of water. For example, between 1.6 2.0 ounces of concentrate is added to or combined with a gallon of water, these being relative proportions.

One basic concentrate formula is:

| Ingredient | Range (weight %) | |
|---|---|---|
| | Broad | Preferred |
| sodium carbonate | 84–90% | 88% |
| sodium bi-carbonate | 10–12% | 11% |
| low-foaming surfactant (BASF PLURAFAC RA-40, or equivalent) | .5–1.5% | 1% |

A second concentrate formula, by way of example is:

| Ingredient | Range (wt. %) | |
|---|---|---|
| | Broad | Preferred |
| potassium carbonate | 86–90% | 89% |
| potassium bi-carbonate | 9–11% | 10% |
| low-foaming surfactant (BASF PLURAFAC RA-40, or equivalent) | .5–1.5% | 1% |

A third concentrate formula, by way of example is:

| Ingredient | Range (wt. %) | |
|---|---|---|
| | Broad | Preferred |
| lithium carbonate | 87–91% | 90.7% |
| sodium bi-carbonate | 8–10% | 8.3% |
| low-foaming surfactant (BASF PLURAFAC RA-40, or equivalent) | .5–1.5% | 1.0% |

Other usable surfactants are:

Polyoxyethylene glycols such as Pluronic L-61, a product of Wyandotte Chemical Co., and Witconnol 171, a product of Witco Chemical Corp; Linear primary alcohol polyether, such as Antarox BJ-225, a product of GAF (General Aniline & Film Corp.); nonyl phenoxy polyethoxy ethanol, such as Triton N-101, a product of Rohm & Haas Company; or any low foaming surfactant that does not craze polycarbonate plastic material.

The above concentrate, which is a free flowing, granular, alkaline powder, mixed with a relatively large volume of water, as referred to, provides a poly carbonate bottle wash solution having a pH below 11.0 and preferably about 10.5. The sodium carbonates and bi-carbonates are readily available and low priced; however, the alkali metal carbonates and bi-carbonates or mixtures of same may used (potassium and lithium for example).

EXAMPLE

The above solution is sprayed onto poly carbonate bottle surfaces, as by means of a spray washer having a spray nozzle, at a temperature or temperatures between 120° F. and 150° F., and preferably about 130° F. The spray wash is continued for 1.5 to 3 minutes. Thereafter, the bottle is rinsed with distilled water, or soft water, for at least about 30 seconds.

A graph of the pH requirements and the alkalinity requirements is given by a plot of the variation of the pH as the alkalinity is reduced by titration with a standard acid. See FIG. 1. Curve A, sodium hydroxide, has a pH much above 11 until nearly all of its alkalinity is used up. Curve B, the basic concentrate formula of the present invention, starts out with a pH below 11.0, which slowly drops as the alkalinity is used up and does not drop below the effective alkali range at pH 8.0 until after more acid is consummed than is used by sodium hydroxide.

The materials of choice are sodium carbonate and sodium bicarbonate; however, other alkali metals such as potassium and lithium give similar acceptable curves.

The above composition and process provide the following benefits.

1. Preparations of the wash solution is readily carried out by mixing of concentrate with cold water.

2. The wash solution is non-foaming at the described concentrations and temperatures.

3. The solution is free of chlorine and thus free of such fumes.

4. The solution removes most paper labels from containers.

5. The solution does not leave odor or after-taste in container, particularly after rinsing.

6. The containers do not become crazed or cracked as a result of washing as described.

I claim:

1. The process of cleaning a poly carbonate bottle, that includes (a) washing the bottle with a composition consisting of an aqueous basic solution containing solute members and relative weight percents consisting of between 84 and 91 weight percent alkali metal carbonate, between 8 and 12 weight percent alkali metal bi-carbonate and about 1 percent low foaming detergent, and (b) then rinsing the bottle with water, (c) the solution pH being at or below 11.0.

2. The process of claim 1 wherein the solution has sufficient alkalinity to be substantially equivalent to 0.35% sodium hydroxide solution.

3. The process of claim 1 wherein the solution pH is about 10.5.

4. The process of claim 1 wherein said members are in the relative weight % proportions:
about 88% sodium carbonate
about 11% sodium bi-carbonate
about 1% surfactant.

5. The process of claim 4 wherein the balance of the solution consists of water.

6. The process of claim 1 wherein the solution consists of a relatively small volume of concentrate containing said members added to a relatively large volume of water.

7. The process of claim 6 wherein said small and large volumes are in the relative proportions 1.6 to 2 ounces of concentrate per gallon of water.

8. The process of claim 1 wherein said washing comprises spraying the container with said solution.

9. The process of claim 8 wherein said spraying is continued for a time interval between 1.5 and 3.0 minutes.

10. The process of one of claims 1 and 8 in which the temperature of the solution is between 120° F. and 150° F.

11. The process of claim 1 wherein said alkali metal carbonate is selected from the group consisting of sodium carbonate, potassium carbonate and lithium carbonate, and said alkali metal bi-carbonate is selected from the group consisting of sodium bi-carbonate, potassium bi-carbonate and lithium bi-carbonate.

12. A free flowing powdery cleaning composition for use in spray cleaning of re-usable poly carbonate drinking water containers that consists of the members with relative weight percents as follows: between 84 and 91 weight percent sodium carbonate, between 8 and 12 weight percent sodium bi-carbonate, and about 1% weight low-foaming surfactant, the composition adapted to be added to water in concentration sufficient to provide a solution pH below 11.0 and sufficient alkalinity to be substantially equivalent to 0.35% sodium hydroxide solution.

13. An aqueous, non-toxic solution usable for spray cleaning of re-usable poly carbonate drinking water containers, the solution consisting of between 1.6 and 2.0 ounces of solute per gallon of water, the solute consisting of between 84 and 91 weight percent alkali metal carbonate, between 8 and 12 weight percent alkali metal bi-carbonate, and about 1% by weight low foaming surfactant, the solution having a pH below 11.0, and sufficient alkalinity to be substantially equivalent to 0.35% sodium hydroxide solution.

14. The solution of claim 13 having a pH of about 10.5.

15. The composition of one of claims 12 and 13 wherein the relative weight percents are as follows:
about 88% alkali metal carbonate
about 11% alkali metal bi-carbonate
about 1% surfactant.

16. The composition of one of claims 12 and 13 wherein the alkali metal carbonate is selected from the group consisting of sodium carbonate, potassium carbonate and lithium carbonate, and said alkali metal bi-carbonate is selected from the group consisting of sodium bi-carbonate, potassium bi-carbonate and lithium bi-carbonate.

17. The composition of claim 1 wherein the surfactant is selected from the group consisting of polyoxyethylene glycol, linear primary alcohol polyether, and nonyl phenoxy polyethoxy ethanol.

18. The composition of claim 16 wherein the alkali metal carbonate is one of the following:

(i) between 84 and 90 percent, by weight, sodium carbonate, (ii) between 86 and 90 percent, by weight, potassium carbonate, (iii) between 87 and 91 percent, by weight lithium carbonate, and the alkali metal bi-carbonate is one of the following:

(iv) between 8 and 12 percent by weight, sodium bi-carbonate, (v) between 9 and 11 percent, by weight, potassium bi-carbonate.

* * * * *